United States Patent [19]

Cedar

[11] Patent Number: 4,693,469

[45] Date of Patent: Sep. 15, 1987

[54] AEROBIC EXERCISE DEVICE

[76] Inventor: Larry Cedar, P.O. Box 319, Van Nuys, Calif. 91408-0319

[21] Appl. No.: 927,399

[22] Filed: Nov. 6, 1986

[51] Int. Cl.[4] ..... A63B 5/22

[52] U.S. Cl. ..... 272/74; 272/117; 272/128

[58] Field of Search ..... 272/74, 128, 123, 122, 272/124, 117

[56] References Cited

U.S. PATENT DOCUMENTS

| | | | |
|---|---|---|---|
| 1,013,782 | 1/1912 | Koch . | |
| 3,062,543 | 11/1962 | Shaboo et al. | 272/128 |
| 3,874,660 | 4/1975 | Brethen | 272/81 |
| 4,305,582 | 12/1981 | Barton | 273/1 G |
| 4,513,963 | 4/1985 | Nelson et al. | 272/128 |
| 4,557,479 | 12/1985 | Guibert | 272/122 |

FOREIGN PATENT DOCUMENTS

| | | | |
|---|---|---|---|
| 1164490 | 3/1984 | Canada | 272/74 |

*Primary Examiner*—Richard J. Scanlan, Jr.
*Attorney, Agent, or Firm*—Milton S. Gerstein

[57] ABSTRACT

A portable exercise device for simulating jumping rope has a handle portion which is connected to a weighted tubular portion via a flexible and stretchable rubber strip. The weighted portion has a weight element mounted in the end of the tube adjacent the handle portion to make the center of gravity of the weighted portion closer to the handle portion. One end of the rubber strip is connected to a rotatably-mounted central shaft extending through the handle portion, so that the shaft and interconnected weighted portion may rotate relative to the handle portion. The other end of the rubber strip projects outwardly from an end of the weighted portion and has a stop member. The weighted portion slides along the rubber strip, so that, when the handle portion is given a swinging motion by an arm, the weighted portion revolves about the handle portion. During the revolving of the weighted portion, the centrifugal force causes the weighted portion to slide outwardly along the rubber strip and abut against the stop member, which rubber strip also stretches from the centrifugal force, to enhance the aerobic workout. When the revolving of the weighted portion is combined with leg movements, jumping rope is completely simulated but in an area not requiring a high ceiling. In a modification, the weighted element is mounted for sliding movement.

15 Claims, 9 Drawing Figures

AEROBIC EXERCISE DEVICE

BACKGROUND OF THE INVENTION

The invention is directed to a portable exercise device that allows for vigorous exercising by persons not able to afford expensive equipment or do not have the time to use facilities at a club or gym. Further, the invention is also directly suited to persons who find it difficult or undesirable to exercise on heavy cumbersome and complicated exercise equipment, such that the invention allows for relatively simple and uncomplicated exercising with substantially the same benefits accruing thereby as compared with these heavy and cumbersome prior-art apparatuses. In particularity, the present invention allows one to simulate jump-roping without the need of a jump rope, with all of the concomitant beneficial results, or to simulate only the arm movements of jump-roping alone without movement of the legs.

Exercise equipment that is portable and easy-to-carry are well-known. An example of such a device is disclosed in U.S. Pat. No. 3,874,660—Brethen, which device is used for isometric exercising and not aerobic, and which device is expressly designed to avoid motion altogether.

SUMMARY OF THE INVENTION

It is the primary objective of the present invention to provide an aerobic exercise device that is portable in nature, light-weight, and facile in use.

It is objective of the invention to provide such a portable aerobic exercise device that allows one to exercise at the site of his choice, such as home, apartment, hotel room, and the like, without the need of setting up complicated or expensive equipment.

It is an objective of the invention to provide such a portable aerobic exercise device that allows one to substantially simulate rope-jumping, for all of the beneficial effects thereof while avoiding tripping over any rope, or having to jump so high over rope to clear it that knees are hurt.

It is yet another objective of the present invention to allow for use of the device of the invention in various ways so as to allow for the development and toning of various muscles.

Toward these and other ends, the portable aerobic exercise device of the invention is substantially made up of of a pair of separated and joined tubular elements, one element serving as a handle by which the device may be gripped by the hand, and the other tubular element serving as a weighted portion. The interconnection between the two elements is achieved via a flexible, stretchable elongated connecting member that, firstly, allows for the rotation of the second, weighted tubular element about the handle element, and, secondly, allows for the second, weighted tubular element to extend radially outwardly by centrifugal force with respect to the first handle element by the stretching of the elongated connecting member, as the second, weighted tubular element is rotated about a center defined by the connection of the flexible connecting member with the first handle element, to provide shock-absorption, or cushioning, during the rotation of the weighted second tubular element. Further, the second weighted element is provided with a weight that is mounted at the end of the second tubular element adjacent the end closest to the first handle element, so that the moment, or torque, created by the weighted tubular element during rotation is considerably reduced, so as to allow for greater control, for providing the best simulation to jump-roping as possible, and for preventing muscular damage and allowing for enhanced aerobic exercising. The handle element is also provided with inner bearings that allow for relative rotation of a shaft or spindle, to one end of which is secured an end of the flexible connecting element, so that, as the handle element is rotated by the hand in circular motion, the second, weighted tubular element is allowed relative rotation with respect to the handle element, thereby simulating the hand and arm motions of jump-roping.

BRIEF DESCRIPTION OF THE DRAWING

The invention will be more readily understood with reference to the accompanying drawing, wherein.

DETAILED DESCRIPTION OF THE INVENTION

Figure 1:
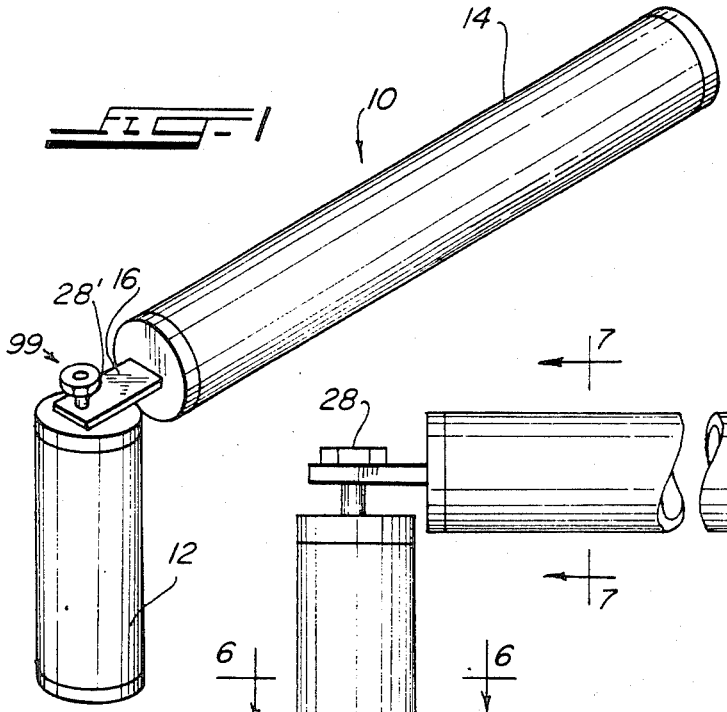
FIG. 1 is a perspective view of the portable exercise device of the present invention.
Figure 2:
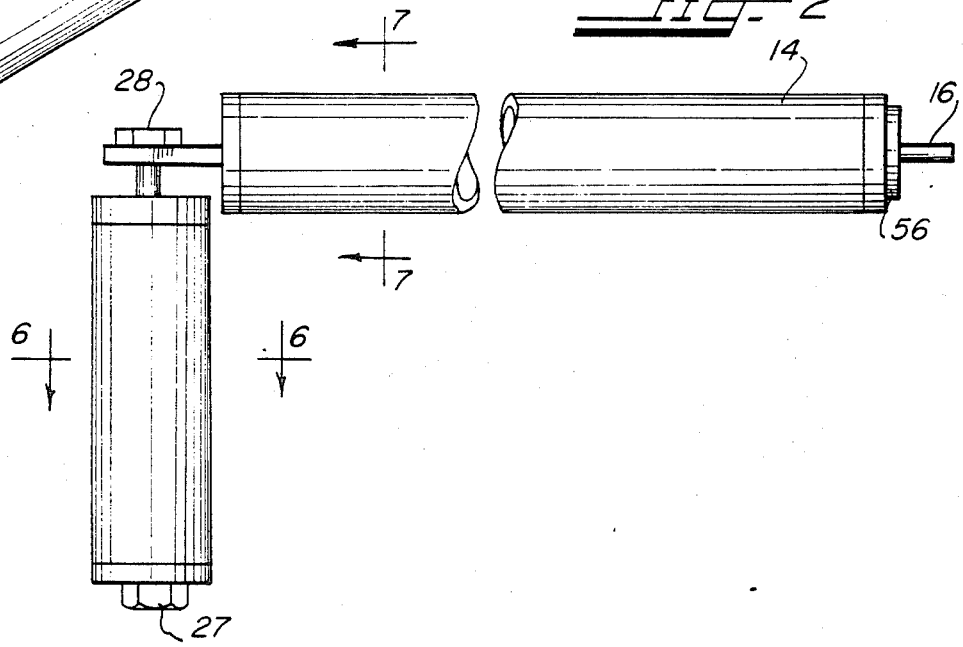
FIG. 2 is a side elevational view of the portable exercise device of FIG. 1.
Figure 3:
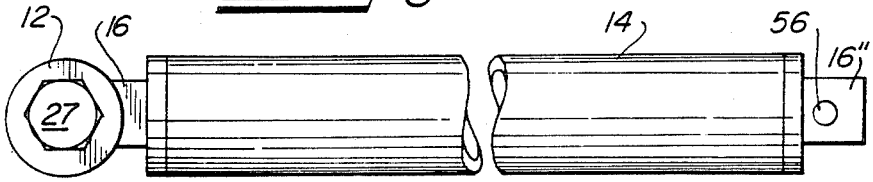
FIG. 3 is a bottom view of the portable exercise device of FIG. 1.
Figure 4:
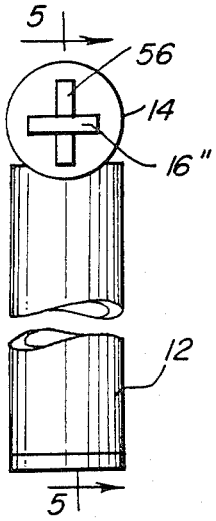
FIG. 4 is a front view of the portable exercise device of FIG. 1.

Referring now to the drawing in greater detail, the portable exercise device of the present invention is indicated generally by reference numeral 10, and includes two main parts: A handle section 12, and a weighted section 14, with the two sections being interconnected by a flexible, stretchable member 16 extending entirely through the weighted section 14. The handle section 12 has a hollow outer tubing 20, seen in FIG. 5, made of any suitable metal, such as aluminum, or plastic. Received in the hollow interior of the outer tubing 20 is a smaller-diameter, hollow inner tubing 22, secured to the end of which are a pair of ball bearings 24, 26 for rotatably mounting a central, axially-extending shaft 28 having an end 28' projecting outwardly beyond an end face of the handle section, as clearly shown in FIG. 5. The shaft 28 may be a threaded bolt having a hexagonal head 27, secured in place by a nut 99 at the other end of the tubing. The ball bearings may be mounted in the ends of the inner tubing 22 in any conventional manner, such as by housing caps 30, 32 either force-fitted into the ends of the hollow outer tubing 20, or screwed thereto, it being understood that any conventional mounting may be used for rotatably mounting the central shaft 28 in the handle section. The handle section may also be provided with a outer, neoprene protective sheath for easy gripping by a hand.

Figures 5, 6, 7, 8, 9:
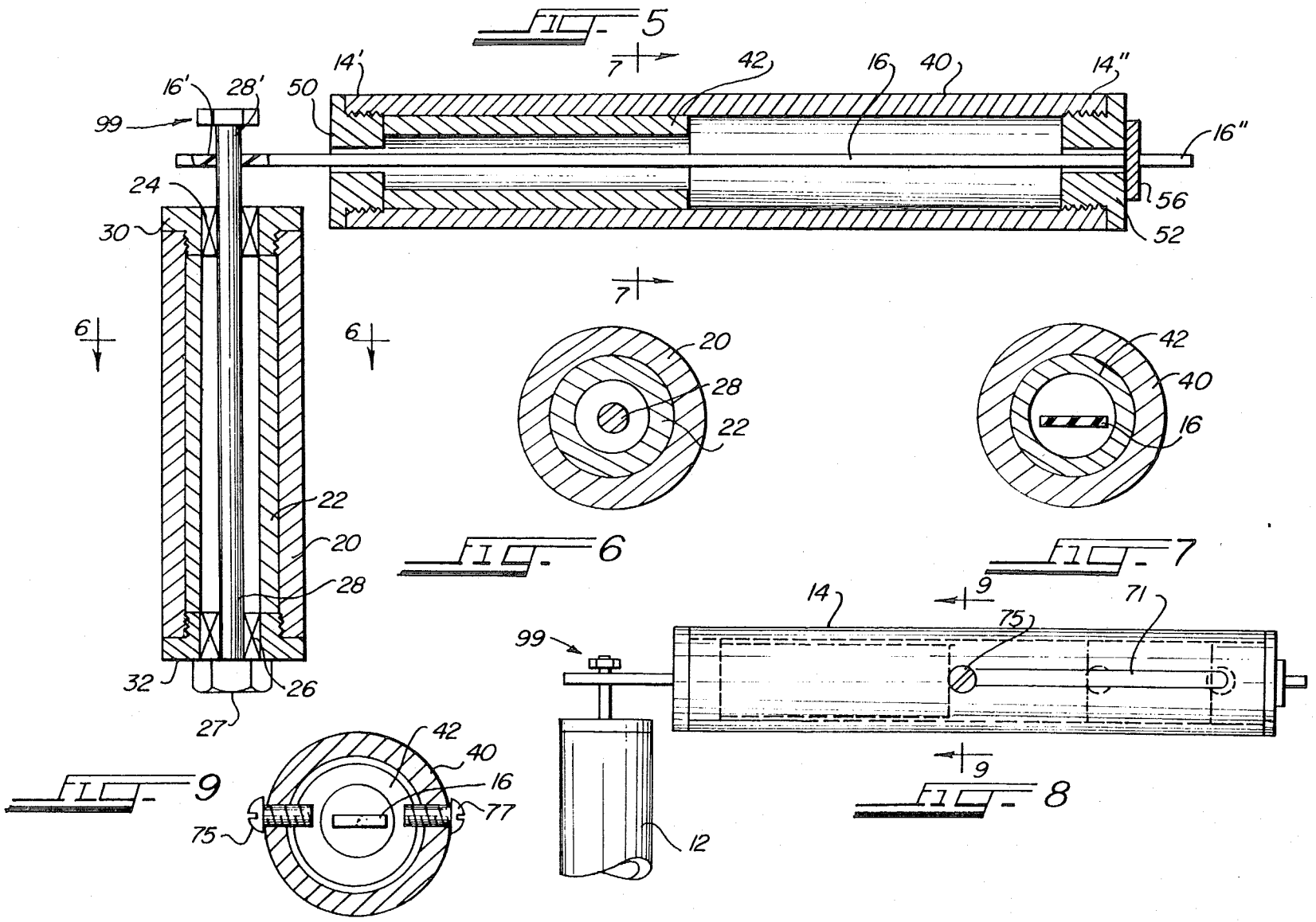
FIG. 5 is a cross-sectional view taken along line 5—5 of FIG. 4.
FIG. 6 is a cross-sectional view taken along line 6—6 of FIG. 2.
FIG. 7 is a cross-sectional view taken along line 7—7 of FIG. 2.
FIG. 8 is a side view of a modification of the invention.
FIG. 9 is a cross-sectional view taken along line 9—9 of FIG. 8.

The weighted section 14 also includes a generally cylindrical, hollow tube 40 seen in FIG. 5, in which is fixedly mounted, in the preferred embodiment, a cylindrical weight-element 42. The weight-element 42 originates adjacent the end 14' of the tube 40, and extends toward the end 14'' for approximately one-third the distance of the tube 40. This ensures that, when the weighted-section 14 is revolved about the handle, the torque created by the weight-element 42 is considerably less than if the element 42 were mounted at the distal end 14'' of the tube 40. This allows for greater stability when the weighted-section 14 is rotated, and provides a safer device, since the weighted portion of the revolving section is nearer the handle portion and, thus, would not tend to cause any harm to a person or object, since the end 14'' of the weighted-section is lighter, the end 14'' being that portion most likely to contact an object or person during revolution. The weight-element 42 may be affixed in place in the hollow tube 40 in conventional manner, such as by adhesive bonding. In the preferred embodiment, the length of the section 14 is twelve inches, with the weight-element 42 extending for four inches therealong beginning adjacent the end 14'. The tube 40 is preferably made of plastic or aluminum, and has a weight itself of approximately four ounces, which, when combined with a three ounce weight-element 42, provide a weighted-section weighing seven ounces, which is also the approximate weight of the handle section 12. Clearly, the faster the weighted-section 14 is revolved about the handle section, the greater the effect of this weighted-section due to centrifugal force. Also, it is clear, that different weights may be used, to either provide for a heavier weighted-section or a lighter one. The weight-element may be made of acrylic, or the like, the greater the density of the material used for the weight-element 42 requiring a lesser distance that it must extend along the tube 40. Thus, for a weight-element 42 made of a dense material, the device 10 would be even safer, since the weight would be concentrated closer to the inner end 14' rather than the distal end 14'', to provide a center of gravity to the weighted-section even closer to the handle section.

As described above, the flexible, stretchable connecting member 16 extends entirely through the weighted section 14. The member 16 has a first, inner end 16' and a second, distal end 16'', both of which project outwardly of the respective ends of the tube 40. The end 16' receives therethrough the end 28' of the central shaft 28 via an appropriately-sized opening formed in the end 16' that snugly receives, in a force-fit manner, a threaded portion of the shank of the shaft 28. The connection between the ends 28' and 16' allows for the revolution of the weighted-section 14 about the center defined at the interconnection of the two ends 16' and 28', with the motion being imparted to the weighted-section 14 via the swinging movement of the handle section 12, when the user of the device revolves or swings the handle section by his arm or hand. The member 16 must be of strong and durable material, such as natural rubber, to allow for the safe and sure connection with the end 28', and still allow for stretching thereof as the device is revolved. The stretching of the member 16 during use provides what may be called a shock-absorbing effect, to lessen or deaden jolts and sudden movements, as well as to provide a stable system the center of gravity of which changes during different rates of rotation of the weighted section 14 about the interconnection of the ends 16' and 28', as described hereinbelow.

The flexible member 16, which in the preferred embodiment is an elongated band, extends through an axial through-opening formed in the weight-element 42, so that the weight-element 42 may slide therealong during rotation of the weighted section 14, which sliding movement is caused by centrifugal force. The band 16 also extends through through-openings formed in end caps 50 and 52 which close off the tube 40. Also, a stop member 56 is provided at the distal end 16'' of the band to limit the outward movement of the weighted section 14 during its revolutions. The stop member 56 may be formed integrally with the band 16, or be provided as a separate piece appropriately connected to the end 16''. It is to be understood that the flexible band 16 may be replaced with parts performing the same effect. For example, a compression spring may be telescopingly mounted about the end 16'' of the band between the stop member 56 and the end 14'' of the tube 40 in order to provide a shock-absorbing effect. In this case, the band 16 need not be stretchable, but may even be embodied by a metal rod. During the revolution of the weighted section 14, its center of gravity is thereby changed, creating even greater torque as the angular rotation is increased.

In use, the handle 12 is gripped by the hand and held substantially parallel to the floor. Thereafter, the arm is swung in circular fashion to cause the rotation of the weighted section 14 about the center of rotation defined by the interconnection between the ends 16' and 28'. The faster the rotation of the arm, the faster the weighted section will revolve, thereby increasing the forces created thereby. The weighted section will move outwardly along the band 16 until the stop 56 is reached, with increased centrifugal force causing the band itself to stretch outwardly, thereby not only creating a shock-absorbing effect, but also inherently increasing the torque by the shifting of the center of gravity of the weighted section. Alternatively, the revolution of the handle portion may be achieved solely by using wrist action, which, when two such devices 10 are used for both hands, the simulation of jumping rope is achieved. In conjunction therewith, jumping leg movements may be carried out simultaneously to completely simulate jumping rope. The device 10 may also be used for leg exercises by providing a suitable strap on the handle portion 12, through which the front portion of a foot may extend, whereby, upon swinging movement of the leg, the weighted-section is caused to revolve.

In FIGS. 8 and 9, a modification of the device is shown, in which the weight-element 42 is mounted for free sliding movement in the tube 40. A pair of diametrically-opposed slots 71 are provided in the tube 40 for threadingly receiving a pair of set screws 75 and 77, which set screws are positionable at any location along the length of the respective slot 71. The set screws act as limit stops to the movement of the weight-element 42 during the rotation of the tube 40 relative to the handle element 12. Thus, the effective torque created during use of the device may be adjusted to suit the individual needs of the exerciser. Alternatively, the slots 71 and screws 75, 77 may be replaced by a series of holes which receive pins therethrough for determining the end to the movement of the weight-element 42, with the pins being forced through the appropriate pair of diametrically-opposed holes in the tube 40 in order to suit the needs of the particular exerciser.

The member 16 may be securely affixed to the central shaft 28, as well as the weight-element 42 to the interior of the tube 40 in the embodiment of FIGS. 1–7, by conventional bonding techniques. The end 16' of the element 16 may also be reinforced by a second, superimposed layer of the same material, which second layer preferably extends also through the central opening of the weight-element 42. The two layers are also bonded to each other by conventional techniques.

While specific embodiments of the invention have been shown and described, it is to be understood that numerous changes and modifications may be made therein without departing from the scope, intent, and spirit of the invention as set forth in the appended claims.

The connection between end 16 of the stretchable member and the end of threaded shaft 28' may be further enhanced by the provision of a cap or nut, 99 at the end of the shaft 28'.

What is claimed is:

1. An aerobic exercise device for use in simulating rope-jumping and other exercises, comprising:

a handle means for gripping the device comprising a first end and a second end spaced from said first end;

a weight means having a first end and a second end spaced from said first end thereof, said first end thereof being closer to said second end of said handle means than said second end of said weight means;

flexible means having a first end connected with said handle means and a second end operatively associated with said weight means for interconnecting said handle means in spaced apart relationship with said weight means;

said handle means comprising an outer circumferential surface portion, and means mounting said first end of said flexible means for rotation relative to said handle means so that said weight means may be revolved about said handle means as said handle means is revolved;

said weight means comprising a substantially hollow tubular element, said flexible means comprising an elongated, axially-stretchable, resilient cord means having an outer diametric extension less than the inner diametric extension of said hollow tubular element, said cord means extending through said hollow tubular element.

2. The aerobic exercise device according to claim 1, wherein said handle means is a substantially hollow cylindrically-shaped element; and said means mounting said first end for rotation comprises a spindle extending substantially longitudinally axially along the interior of said cylindrically-shaped element, and bearing means positioned in said cylindrically-shaped element for mounting said spindle for rotation relative to said cylindricallyshaped element.

3. The aerobic exercise device according to claim 1, wherein said weight means further comprises a weight element positioned in said hollow tubular element directly adjacent said first end of said weight means closer to said handle means than said second end of said weight means, so that the moment of inertia created during the revolution of said weight means about said handle means is reduced.

4. The aerobic exercise device according to claim 3, wherein said weight element has a through-opening formed therein for the passage therethrough of a portion of said cord means.

5. The aerobic exercise device according to claim 3, wherein said second end of said cord means comprises a stop means; said cord means having a length greater than the length of said hollow tubular element taken along the longitudinal axis of said tubular element, said weight means being slidingly mounted with respect to said cord means, so that, as said weight means is revolved about said handle means, centrifugal force causes said weight means toward said stop means which limits further movement thereof.

6. The aerobic exercise device according to claim 2, wherein said spindle comprises an end adjacent the second end of said hollow cylindrically-shaped element, said end of said spindle projecting axially outwardly beyond said second end of said hollow cylindrically-shaped element; said first end of said flexible means projecting axially-outwardly beyond said first end of said weight means; and means for connecting said end of said spindle to said first end of said flexible means.

7. The aerobic exercise device according to claim 3, wherein said weight element weighs between 2–4 ounces, and extends approximately between one-fourth and one-third of the total length of said hollow tubular element originating directly adjacent said first end thereof.

8. The aerobic exercise device according to claim 2, wherein said spindle comprises a first end and a second end, said second end of said spindle projecting outwardly beyond said second end of said handle means and through said first end of said flexible means such that said second end of said spindle means projects outwardly of said flexible means to provide a stop for preventing said flexible means from being pulled through said weight means.

9. The aerobic exercise device according to claim 8, wherein said handle means has a total length of approximately between one-half and one-third the total length of said weight means.

10. The aerobic exercise device according to claim 8, wherein said handle means comprises an outer protective sheath foam covering for easy gripping.

11. The aerobic exercise device according to claim 9, wherein said handle means weighs approximately the same as said weight means.

12. A portable exercise device comprising:

a handle portion for gripping by a hand;

a weighted housing portion connected to said handle portion;

means for interconnecting said handle portion and said weighted housing portion comprising a flexible cord having a first end connected to said handle portion and a second end connected to said weighted housing portion, whereby said weighted housing portion may be revolved about said handle portion;

said weighted housing portion comprising a first end and a second end, said first end lying closer to said handle portion than said second end thereof;

said weighted housing portion further comprising a hollow tubular means, a weight-element mounted for sliding movement in said hollow tubular means, and means for adjustably limiting the position of said weight-element in the hollow interior of said hollow tubular means during the revolution thereof, said means for adjustably limiting having a plurality of positions so that the torque created during the revolutions of said weighted housing portion relative to said handle portion is adjustable to suit the needs of the individual.

13. The exercise device according to claim 12, wherein said handle portion comprises bearing means for rotatably mounting said first end of said means for interconnecting.

14. The exercise device according to claim 12, wherein said means for adjustably limiting comprises a pair of mutually-aligned and diametrically-opposed slots formed in the surface of said hollow tubular means, elongated means passing through said pair of slots against which said weight-element abuts during revolution, and means for securing said elongated means in place at the desired locations of said slots.

15. The exercise device according to claim 12, wherein said means for adjustably limiting comprises a first and a second series of plurality of holes formed in diametrically-opposed surfaces of said hollow tubular means, and pin means for insertion into selected ones of said holes against which said weight-element abuts during revolution.

* * * * *